US012258758B2

(12) United States Patent
Suchyna et al.

(10) Patent No.: US 12,258,758 B2
(45) Date of Patent: Mar. 25, 2025

(54) COLUMN COVER AND METHODS OF MANUFACTURE AND INSTALLATION

(71) Applicant: Barrette Outdoor Living, Inc., Middleburg Heights, OH (US)

(72) Inventors: Mark G. Suchyna, Lancaster, PA (US); Douglas L. Mucher, Buffalo, NY (US); Christopher Vincent, Orem, UT (US); Rosline Christian, Ann Arbor, MI (US); Timothy Briggs, Clinton, MA (US); Cevan Skinner, Orem, UT (US); Matthew Rapposelli, Conschohocken, PA (US)

(73) Assignee: Barrette Outdoor Living, Inc., Middleburg Heights, OH (US)

( * ) Notice: Subject to any disclaimer, the term of this patent is extended or adjusted under 35 U.S.C. 154(b) by 107 days.

(21) Appl. No.: 17/543,797

(22) Filed: Dec. 7, 2021

(65) Prior Publication Data

US 2022/0178142 A1 Jun. 9, 2022

Related U.S. Application Data

(60) Provisional application No. 63/122,353, filed on Dec. 7, 2020.

(51) Int. Cl.
*E04C 3/36* (2006.01)
*E04F 13/073* (2006.01)

(52) U.S. Cl.
CPC ..... *E04C 3/36* (2013.01); *E04F 13/0736* (2013.01)

(58) Field of Classification Search
CPC ..... E04C 3/36; E04F 13/0736; E04F 13/185; E01F 15/141; E01F 15/0469; E04H 12/2292
See application file for complete search history.

(56) References Cited

U.S. PATENT DOCUMENTS 4,007,919 A * 2/1977 Totten ..... E04H 17/1413 256/65.13
4,488,390 A * 12/1984 Mulford ..... E04D 13/178 52/407.1

(Continued)

OTHER PUBLICATIONS

Barron Designs, "Colorado Dry Stack Stone Split Column Wrap—Narrow," product design available online on Dec. 6, 2020.

(Continued)

*Primary Examiner* — Rodney Mintz
(74) *Attorney, Agent, or Firm* — John Maldjian; Stevens & Lee PC

(57) ABSTRACT

The present disclosure relates generally to a column cover comprising a first portion comprising a first side panel having a first edge and a second edge, a second side panel having a first edge and a second edge, a front panel extending between the second edge of the first side panel and the second edge of the second side panel, and an outer surface having at least one textured contour that replicates a natural building material. The cover further comprises a second portion comprising a first side panel having a first edge and a second edge, wherein the first side panel of the second portion is substantially coplanar with the first side panel of the first portion, wherein the first edge of the first side panel of the first portion is spaced apart from the first edge of the first side panel of the second portion.

19 Claims, 9 Drawing Sheets

(56) References Cited

U.S. PATENT DOCUMENTS 5,480,126 A * 1/1996 Teasdale ..... E01F 15/0469 256/19
6,242,070 B1 * 6/2001 Gillispie ..... E01F 15/141 428/122
7,163,140 B1 * 1/2007 Kaiser ..... A47G 29/1216 232/38
9,732,485 B2 * 8/2017 McCue ..... E04C 3/36
11,019,952 B2 * 6/2021 Machande ..... E04H 12/02
11,498,357 B2 * 11/2022 Briggs ..... B44C 3/123
2007/0256388 A1 * 11/2007 Ianello ..... E04H 12/2292 52/651.07
2008/0000192 A1 * 1/2008 McGlinch ..... E04H 12/2292 52/835
2009/0044486 A1 * 2/2009 Kimura ..... E04B 1/943 52/831
2009/0235596 A1 * 9/2009 Tyler ..... E04F 19/024 52/287.1
2011/0030292 A1 * 2/2011 Oram ..... C04B 28/14 52/173.1
2014/0054528 A1 * 2/2014 Boggs ..... E04H 17/17 256/24
2016/0032593 A1 * 2/2016 Biterman ..... E04F 13/0862 264/319
2016/0215464 A1 * 7/2016 McCue ..... E01F 15/141
2020/0323375 A1 * 10/2020 Machande ..... E04H 12/2292
2020/0398609 A1 * 12/2020 Briggs ..... E04F 13/0871

OTHER PUBLICATIONS

Deck Expressions, "Next Stone—New Country Ledgestone 2pc Post Covers by Nextstone," product design available online on Dec. 6, 2020.

NextStone, "Country Ledgestone 2pc Post Covers," product design available online on Dec. 6, 2020.

* cited by examiner

COLUMN COVER AND METHODS OF MANUFACTURE AND INSTALLATION

CROSS-REFERENCE TO RELATED APPLICATIONS

This application claims the benefit of priority of U.S. Provisional Patent Application No. 63/122,353, filed Dec. 7, 2020, which is hereby incorporated herein by reference in its entirety.

BACKGROUND OF THE DISCLOSURE

1. Field of the Disclosure

The present disclosure relates generally to column coverings and more particularly to a polymer wall covering having the appearance of a masonry.

2. Technical Background

Fences and walls that appear as masonry walls are popular. Masonry is attractive and provides an impression of strength and stability. Stone masonry, in particular, is popular for walls because it has a heavy stable appearance.

However, masonry is costly to install. The stones or bricks are laid individually and attached to the surrounding elements of the wall using mortar. Even veneers of thin masonry require attaching stone or brick to the wall substrate using mortar. Achieving a satisfactory appearance is difficult, and professional stone masons are often used to create the veneer, which is costly.

Large faux stone or brick panels made of polymer, which represent a group of stones or bricks, are easier to install. However, in certain instances these panels are easily distinguished from true masonry. The large panels have a distinct pattern of a group of stones, which identically repeats over the expanse of the wall. If a person observes the wall closely, they are likely to notice the pattern and then identify that the pattern repeats. As a result, even if the individual stones or bricks have a realistic appearance, the repeating pattern will reveal that the wall is not truly masonry. Additionally, the interface or joint between sections of a faux stone wall can appear unnatural when observed. Specifically, the joint between a column and the adjacent wall sections.

Accordingly, a need exists for an improved column cover.

SUMMARY OF THE DISCLOSURE

In one aspect, the disclosure provides a column cover having an appearance of a traditional building material, the column cover comprising:

a first portion comprising:

a first side panel having a first edge and a second edge;

a second side panel having a first edge and a second edge;

a front panel extending between the second edge of the first side panel and the second edge of the second side panel; and an outer surface having at least one textured contour that replicates a natural building material; and a second portion comprising:

a first side panel having a first edge and a second edge, wherein the first side panel of the second portion is substantially coplanar with the first side panel of the first portion;

a second side panel having a first edge and a second edge;

a front panel extending between the second edge of the first side panel and the second edge of the second side panel; and an outer surface having at least one textured contour that replicates a natural building material, wherein the first edge of the first side panel of the first portion is spaced apart from the first edge of the first side panel of the second portion.

In another aspect, the disclosure provides a method of assembling a column cover, the method comprising:

receiving a first side of a post between a first inner side panel and a second inner side panel of a first column cover portion;

securing the first column cover portion to the post;

receiving a second side of the post between a first inner side panel and a second inner side panel of a second column cover portion;

positioning the second column cover portion relative to the first column cover portion such that a first edge of a first side panel of the second column cover portion is spaced apart from a first edge of a first side panel of the first column cover portion; and securing the second column cover portion to the post.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

One aspect of the disclosure is a system for a wall or fence having an appearance of a masonry wall. The system includes one or more column covers. Each column cover includes a first column cover portion and a second column cover portion. The column cover portion comprises: a square channel shaped outer wall including a first side panel having a first edge and a second edge, a second side panel having a first edge and a second edge, and a front panel extending between the second edge of the first side panel and the second edge of the second side panel. The column cover portion further comprises a square channel shaped inner wall including a first side panel having a first edge and a second edge, a second side panel having a first edge and a second edge, and a front panel extending between the second edges of the first and second side panels. A first back panel extends between the first edge of the outer first side panel and the first edge of the inner first side panel. Similarly, a second back panel extends between first edge of the outer second side panel and the first edge of the second inner side panel.

The column cover portion further comprises attachment structure for coupling the column cover to a column or post. In some embodiments, the attachment structure comprises one or more protrusions extending from the inner wall. In some forms, the one or more protrusions extend upward from at least one of the inner first side panel, the inner second side panel, or the inner front panel. In operation, the column cover portion is positioned proximate a post such that screws or bolts can be used to couple the protrusions to the post.

Figure 1:
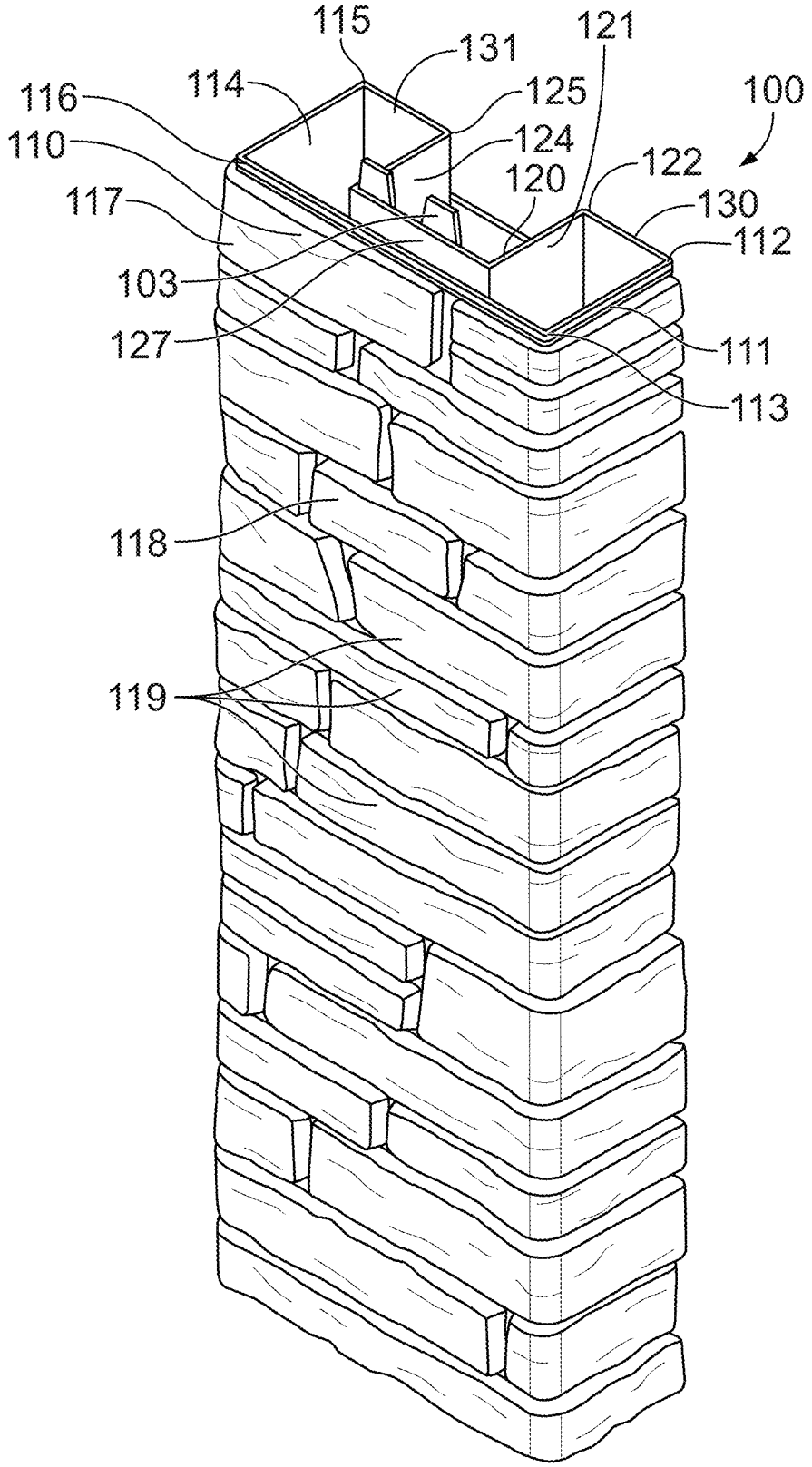
FIG. 1 is a front perspective view of a portion of a column cover according to an embodiment of the disclosure.
Figure 2:
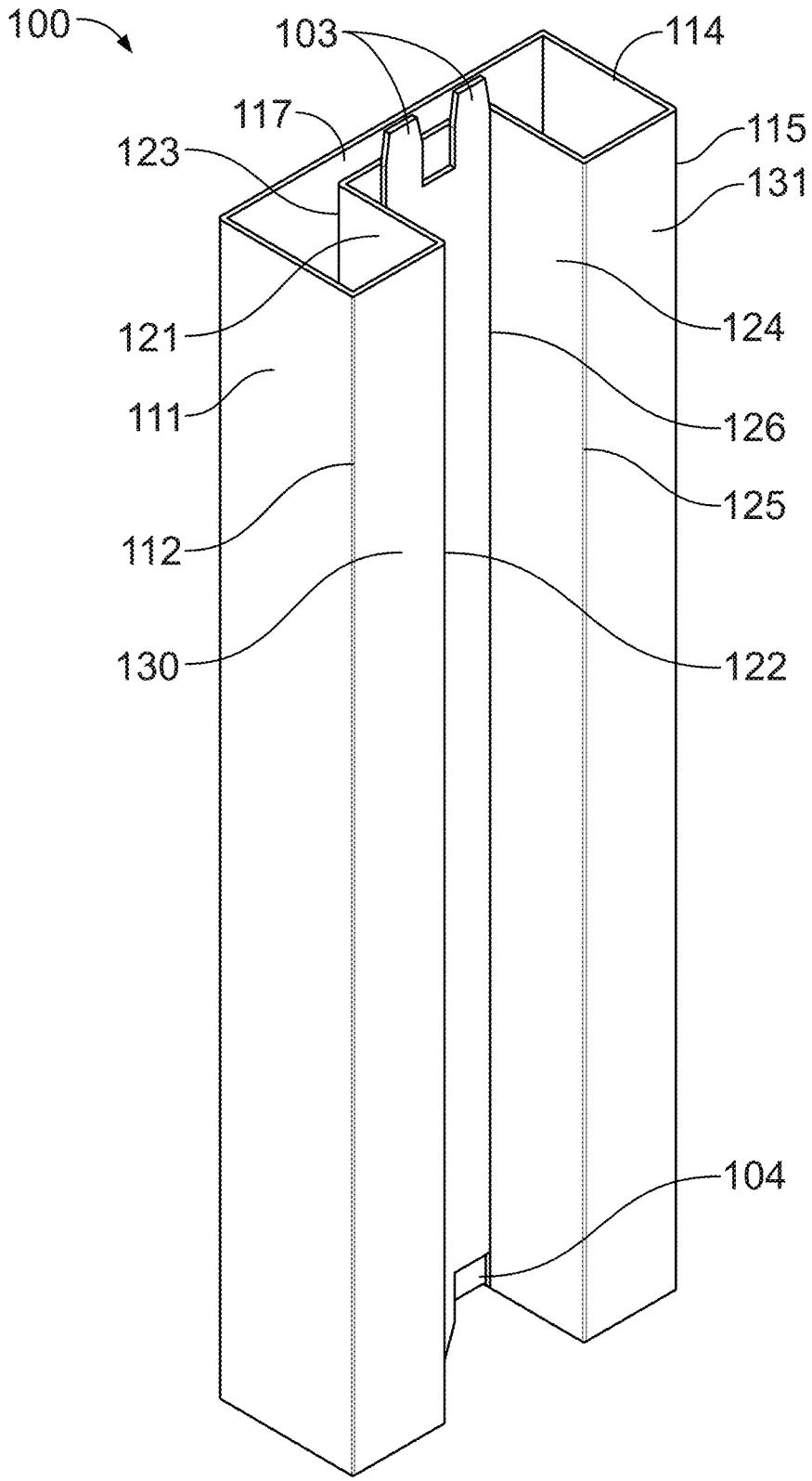
FIG. 2 is a rear perspective view of the column cover portion of FIG. 1.
Figure 3:
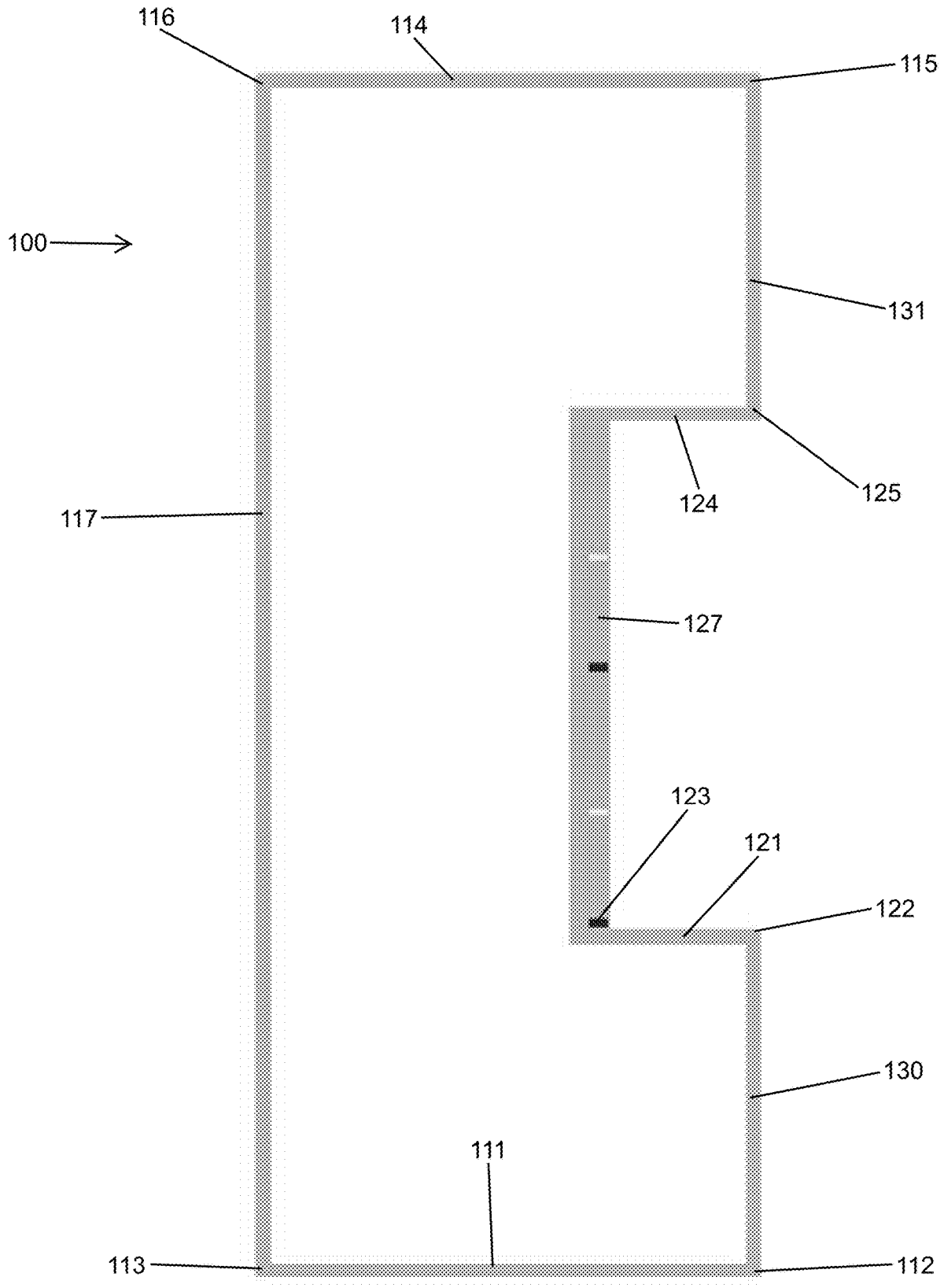
FIG. 3 is a schematic top view of the column cover portion of FIG. 2.

Such a column cover portion 100 is shown in perspective view in FIGS. 1 and 2 and in a top plan view in FIG. 3. The column cover portion includes an outer wall 110 and a nested inner wall 120.

The outer wall 110 includes a first side panel 111, a second side panel 114, and a front panel 117. The first side panel 111 has a first edge 112 and a second edge 113. The first and second edges 112, 113 are substantially vertical. The second side panel 114 is substantially parallel to the first side panel 111. The second side panel 114 includes a first edge 115 and a second edge 116 which are substantially vertical. The front panel 117 extends from the second edge 113 of the first side panel 111 to the second edge 116 of the second side panel 114. Accordingly, the outer wall 110 is shaped like a square channel.

The outer wall 110 further includes an outer surface 118. The outer surface 118 includes a plurality of cosmetic features 119 giving the column cover portion the appearance of a traditional building material. In some embodiments, the cosmetic features 119 include polymer shapes having the appearance of masonry blocks or stones. In alternative embodiments, the cosmetic features have the appearance of wood, brick, or other building materials.

The inner wall 120 includes a first side panel 121, a second side panel 124, and a front panel 127. The first side panel 121 has a first edge 122 and a second edge 123. The first and second edges 122, 123 are substantially vertical. The second side panel 124 is substantially parallel to the first side panel 121. The second side panel 124 includes a first edge 125 and a second edge 126 which are substantially vertical. The front panel 127 extends from the second edge 123 of the first side panel 121 to the second edge 126 of the second side panel 124. Accordingly, the inner wall 120 is shaped like a square channel. The inner wall 120 is at least partially nested within the square channel shaped outer wall 110 as shown in FIGS. 1-3.

The inner wall 120 and outer wall 110 are connected by a pair of back panels 130, 131. The first back panel 130 extends between the first edges 112, 122 of the outer first side panel 111 and the inner first side panel 121. The second back panel 131 extends between the first edges 115, 125 of the outer second side panel 114 and the inner second side panel 124.

Figure 5A:
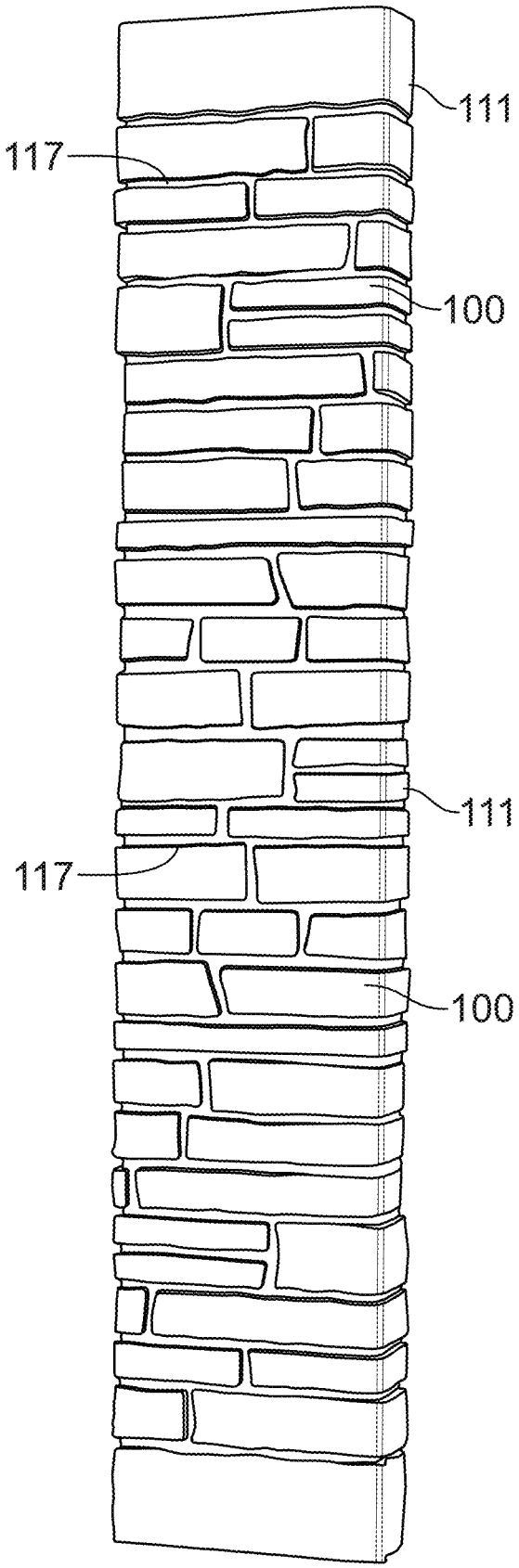
FIG. 5A is a perspective view of two column cover portions according to yet another embodiment of the disclosure.
Figure 5B:
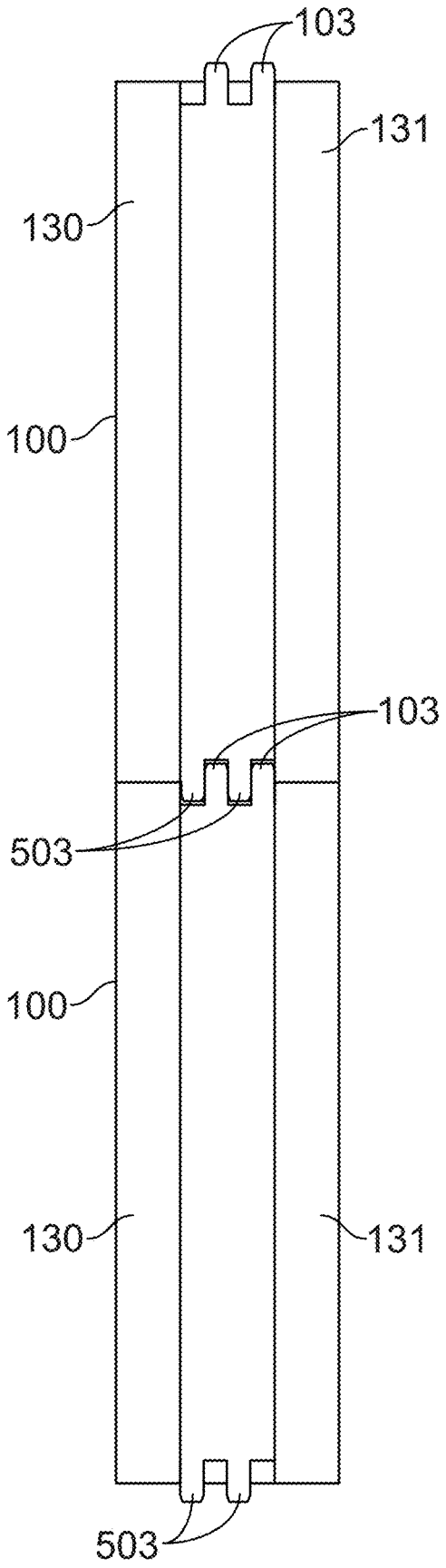
FIG. 5B is a rear view of the two column cover portion of FIG. 5A.

The column cover portion 100 further includes attachment structure 102 for coupling the column cover portion 100 to adjacent structure, such as a post, a second column cover portion, and/or a column cap. In some embodiments, the attachment structure includes upward extending protrusions 103. The protrusions 103 a configured to be received within corresponding recesses 104 in a second column cover portion 100 when the second column cover portion 100 is positioned on top of the first as shown in FIGS. 5A-5B. The interface between the protrusions 103 and recesses 104 locate the column cover portions 100 relative to each other so as to reduce visibility of the seam therebetween. Accordingly, a plurality of column cover portions 100 can be used to create the appearance of taller columns. The protrusions 103 can similarly be received within recesses in a column cap or header (not shown) to similarly locate the column cap relative to the column cover portion 100.

In some forms, the column cover portion 100 can further include downward extending protrusions 503. The downward extending protrusions 503 are positioned so as to interlock with the upward extending protrusions 103 of an adjacent column cover portion 100 when stacked as shown in FIGS. 5A-5B. The downward extending protrusions 503 can be received with in recesses in a second column cover portion 100 or in a column base portion (not shown).

Alternatively or additionally, the protrusions 100 are used to couple the column cover portion 100 to a post. In some embodiments, the protrusions 100 are sized to receive screws or bolts for coupling the column cover portion 100 to the post. Alternatively, the protrusions are shaped to couple to a bracket or brace coupling the column cover portion 100 to the post or two a second column cover portion 100 located on the opposite side of the post, capturing the post therebetween. In still further examples, the post is coupled directly to the inner wall 120 of the column cover portion 100 by adhesive, screws, bolts, other fasteners, or combinations thereof.

Figure 4:
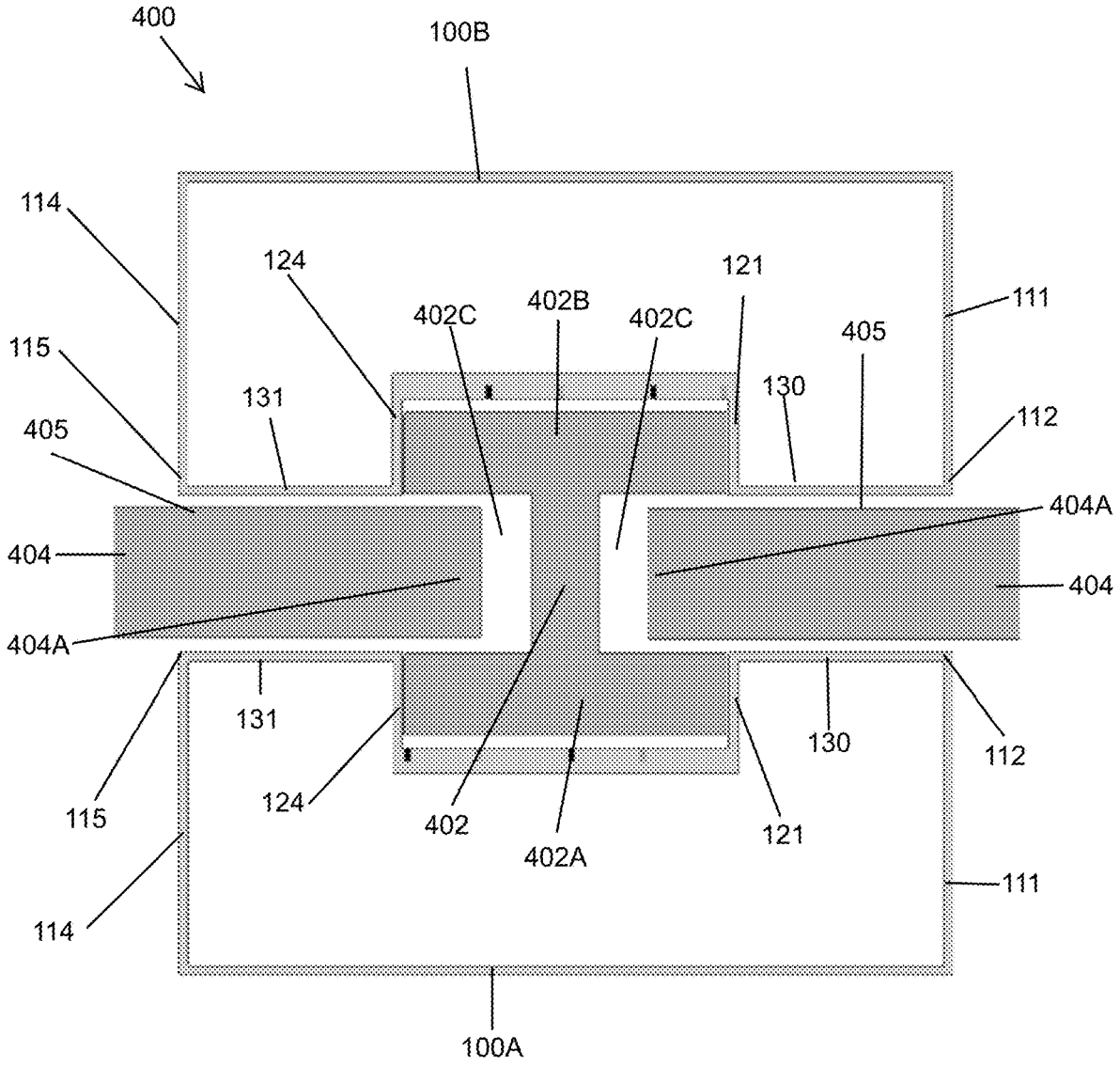
FIG. 4 is a schematic top view of a wall assembly including two column cover portions of FIG. 3.

In operation, a pair of column cover portions 100 are used to simulate a column. Turning to FIG. 4, a wall assembly 400 includes a faux column 410 comprising a first column cover portion 100A is positioned on a first side 402A of a post 402 and a second column cover portion 100B positioned on a second side 402B of the post 402. The inner side panels 121, 124 of the first column cover portion 100A are spaced apart so as to at least partially receive the post 402 therebetween. Similarly, the inner side panels 121, 124 of the second column cover portion 100B are spaced apart so as to at least partially receive the post 402 therebetween.

The first and second column cover portions 100A/100B are coupled to the post 402 with the back panels 130/131 of the first column cover portion 100A spaced from the back panels 130/131 of the second column cover portion 100B. A wall section 404 is positioned at least partially within the gap 405 between the back panels 130/131 of the column cover portions 100A/100B as shown in FIG. 4.

In some embodiments, the post 402 is an H-post having opposed cavities 402C. The cavities 402C are each configured to receive an end 404A of the wall section 404. The wall portion 404 is coupled to the post 402. Alternatively or additionally, the wall portion 404 is coupled to the column cover portions 100A/100B by adhesive, screws, bolts, nails, other traditional fasteners, or combinations thereof.

The first edges 112/115 of the outer wall side panels 111/114 are substantially flush with the outer surfaces of the wall section 404. In some forms, the first edges 112/115 are nonlinear, and are configured to interlock with the faux stone cover of the wall section 404 to form a more natural looking seam therebetween.

Figure 6:
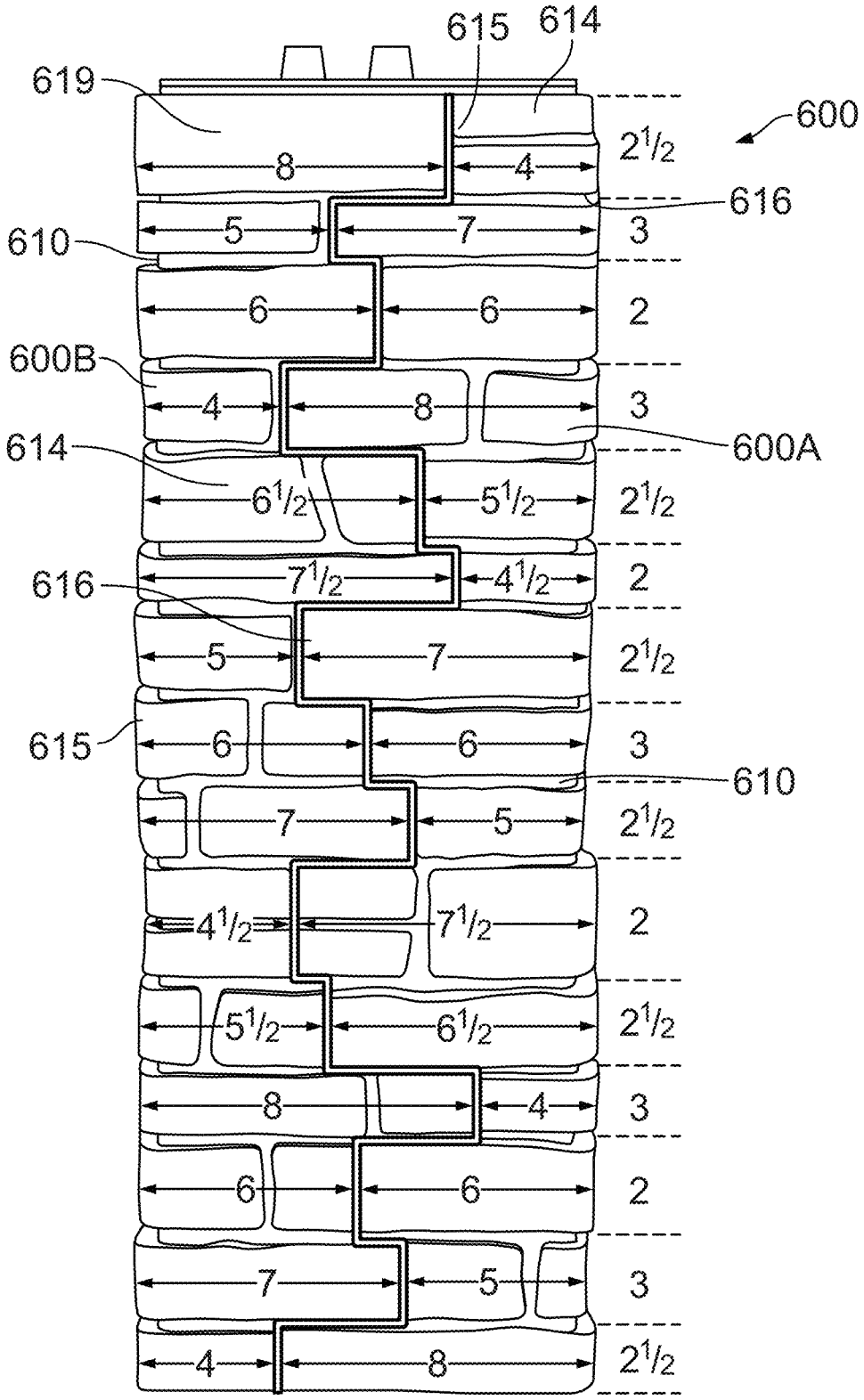
FIG. 6 is a side view of a column cover according to another embodiment of the disclosure.

In addition to having columns between two wall sections 404, as shown in FIG. 4, a wall or fence may include end columns. FIG. 6 illustrates an end column cover 600 formed of two end column cover portions 600A/600B. Similar to the column cover portions 100 described above, the column cover portions 600A/600B include a square channel shaped outer wall 610 with a square channel shaped inner wall (not shown) at least partially nested within the outer wall 610. The second side panel 614 of the first column cover portion 600A and the second side panel 614 of the second column cover portion 600B are wider than the corresponding side panels 114 of the column cover portion 100. When the column cover portions 600A/600B are installed on a post, the first edges 615 of the second side panels 614 engage each other to form a seam therebetween. The engagement of the first edges 615 give the first and second column cover portions 600A/600B the appearance of a single solid column, such as a masonry column.

In some embodiments, the first edges 615 are not linear such that the width of the second side panels 614 vary along the height of the column cover portions 600A/600B. As shown, the edges 615 follow the pattern of the faux masonry features 619, for example following the mortar line between individual faux stones. The two first edges 615 are configured to interlock.

In some forms, the faux masonry features 619 follow a nonrepeating pattern to appear more natural. As shown, the width and height of the faux masonry features 619 vary. Accordingly, the seam between the two column cover portions 600A/600B has a nonrepeating stepped pattern, wherein the steps have a varying height and width. The nonrepeating pattern aids in forming a natural appearing column, and in hiding the seam. The remaining sides of the column cover portions 600A/600B are substantially similar to the corresponding sides of the column cover portions 100 described above.

Figure 7:
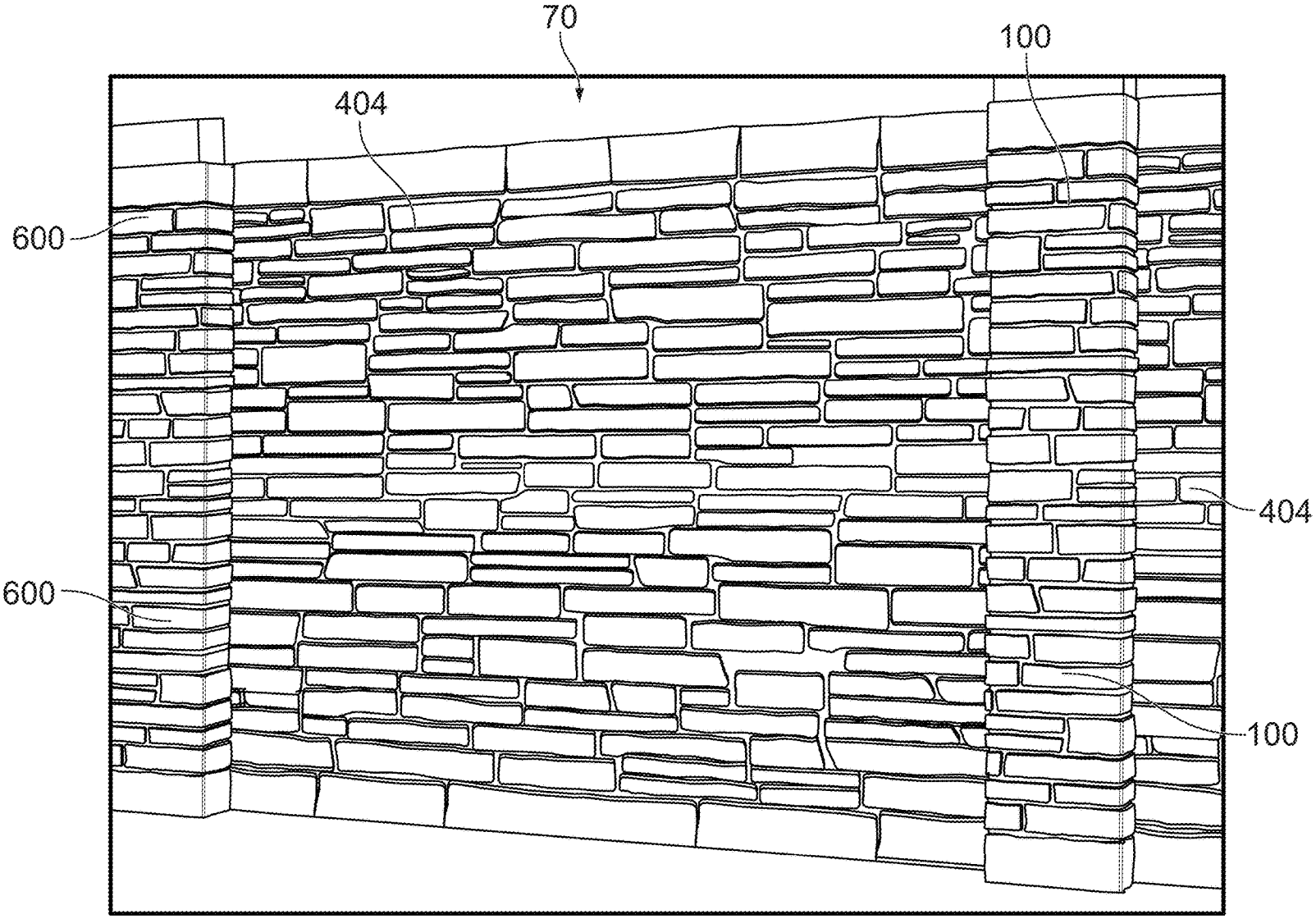
FIG. 7 is a perspective view of a wall section including column cover portions according to another embodiment of the disclosure.

FIG. 7 illustrates a wall 70 formed of wall sections 404, column cover portions 100 and end column cover portions 600. The wall sections 404, column cover portions 100, and end column portions 600 are assembled to have the appearance of a masonry wall. Column cover portions 100 are positioned over the posts between adjacent wall sections 404. The end column cover portions 600 are positioned over the posts on the ends of the wall 70.

Figure 8:
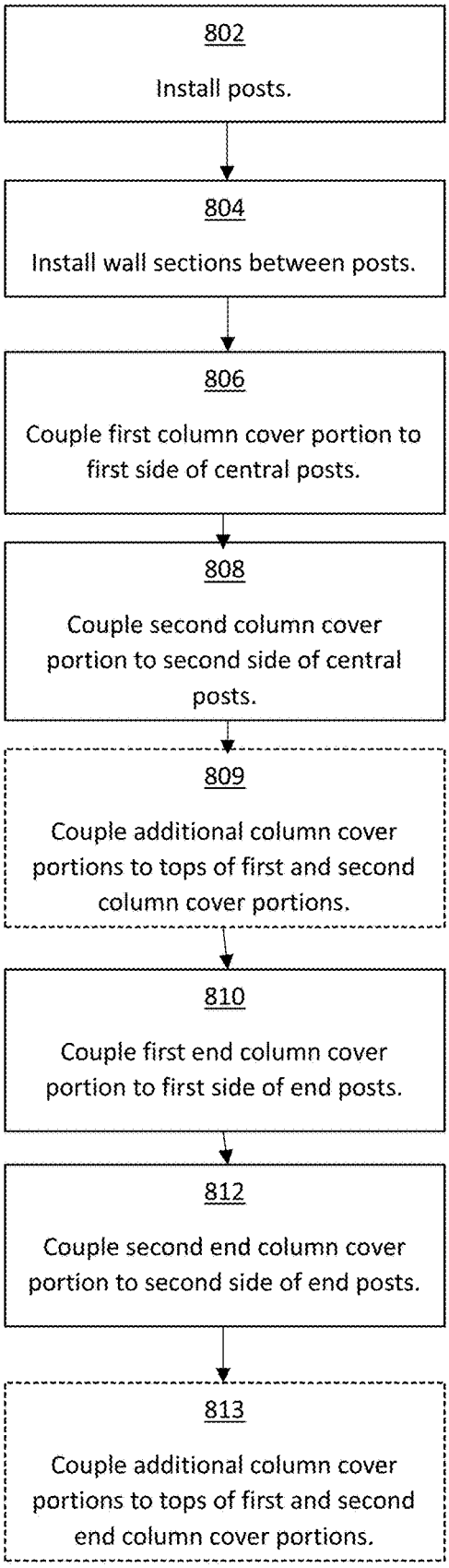
FIG. 8 is a flowchart illustrating a method of assembling a wall including column covers.

FIG. 8 illustrates a method 800 of assembling a faux masonry wall 70. The method 800 includes installing 802 the posts along the path of the wall. The posts are installed in a traditional manner, for example by coupling the posts to a buried steel insert or concrete footer. The wall sections 404 are then installed 804 between the posts.

A first column cover portion 100 is coupled 806 to a first side of a central post. Installing the first column cover portion 100 comprises positioning the first column cover portion 100 such that a first side of the post is at least partially received between the first and second inner side panels 121, 124. The back panels 130, 131 are positioned to be substantially coplanar with one side of the cavity of the post, such that the back panels 130, 131 are proximate the surface of the wall section 404. The first column cover portion 100 is secured to the post with traditional fasteners.

A second column cover portion 100 is coupled 808 to the second, opposite side of the center post. Installing the second column cover portion 100 comprises positioning the second column cover portion 100 such that the second, opposite side of the post is at least partially received between the first and second inner side panels 121, 124. The back panels 130, 131 are positioned to be substantially coplanar with one side of the cavity of the post, such that the back panels 130, 131 are proximate the surface of the wall section 404. The first edges 112, 115 of the outer side panels 111, 114 of the first column cover portion 100 are spaced from the first edges 112, 115 of the outer side panels 111, 114 of the second column cover portion 100 by a distance substantially equal to the width of the wall section 404. In some examples, the wall section 404 has a thickness of between 1 inch and 4 inches. In one example, the wall section 404 is approximately 2 inches wide. The second column cover portion 100 is secured to the post with traditional fasteners.

In some applications, additional column cover portions 100 are coupled 809 to the top ends of the first and second column cover portions 100. The additional column cover portions 100 are placed on top of respective ones of the first and second column cover portions 100 such that the protrusions 103 of the first or second column cover portion 100 is received within corresponding recesses 104 of the additional column cover portion 100. The additional column cover portions 100 are then coupled to the post in substantially the same manner as described in steps 806-808 above.

A first end column cover portion 600 is secured 810 to the first side of an end post. Installing the first end column cover portion 600 comprises positioning the first end column cover portion 600 such that a first side of the post is at least partially received between the first and second inner side panels. The first edge 112 of the first side panel 111 is positioned to be substantially flush with one side of the cavity of the post, such that the first edge is proximate the surface of the wall section 404. The first edge 614 of the second side panel 613 is positioned such that at least a portion of the first edge 614 extends to at least the middle point of the post. The first end column cover portion 600 is secured to the post with traditional fasteners.

A second end column cover portion 600 is coupled 812 to the second, opposite side of the end post. Installing the second end column cover portion 600 comprises positioning the second end column cover portion 600 such that the second, opposite side of the post is at least partially received between the first and second inner side panels. The first edge 112 of the first side panel 111 is positioned to be substantially flush with one side of the cavity of the post, such that the first edge 112 is proximate the surface of the wall section 404. The first edge 614 of the second side panel 613 is positioned such that it is adjacent to the first edge 614 of the second side panel 613 of the first end column cover portion 600. As discussed above, the first edges 614 of the second side panels 613 are nonlinear and follow the faux masonry pattern of the end column cover portions 600. The first edges 614 are configured to interlock, such that the first edge 614 of the second end column cover portion 600 is adjacent the first edge 614 of the first end column cover portion 600 along substantially the entire height of the end column cover portion 600. The second end column cover portion 600 is secured to the post with traditional fasteners.

In some applications, additional end column cover portions 600 are coupled 813 to the top of the first and second end column cover portions 600. The additional end column cover portions 600 are placed on top of respective ones of the first and second column end column cover portions 600 such that the protrusions 103 of the first or second column end column cover portions 600 is received within corresponding recesses 104 of the additional end column cover portions 600. The additional end column cover portions 600 are then coupled to the post in substantially the same manner as described in steps 810-812 above.

In some embodiments, the column cover portions 100, 600 described above are sized to comply with standard construction dimensions. In some forms, the front panels 117 of the column cover portions 100, 600 are between approximately 8 inches and approximately 24 inches wide. In one form, the front panels 117 are approximately 12 inches wide.

The first side panels 111 are less than half the width of the front panels 117. In some forms, the first side panels 111 are between approximately 3 inches and approximately 11 inches wide. In one form, the first side panels 111 are approximately 5 inches wide.

The second side panels 114 of the column cover portions 100 are substantially the same width as the first side panels 111. The second side panels 614 of the end column cover portions 600 have a varying width that ranges from approximately 25% to approximately 75% of the width of the front panel 117. In some forms, the second side panels 614 have a width that ranges from approximately 33% to approximately 67% of the width of the front panel 117. The average width of the second side panels 614 is substantially equal to half the width of the front panel 117.

The distance between the inner side panels 121, 124 is substantially equal to the width of a standard sized post. In some examples, the distance between inner side panels 121, 124 is substantially equal to the width of a standard 4 inch post, 5 inch post, or 6 inch post. In some forms, the distance between inner side panels 121, 124 is substantially equal to the width of a standard wood post, such as 3.5 inches for a 4×4 post, 4.5 inches for a 5×5 post, or 5.5 inches for a 6×6 post.

When installed, the first edges 112 of the first side panels 111 of the column cover portions 100, 600 are spaced apart by approximately the thickness of a standard wall section 404. In some embodiments, the first edges 112 of the column cover portions are spaced apart by approximately 1 inch, approximately 2 inches, or approximately 4 inches.

The column cover portions 100, 600 have a height of between approximately 3 feet and approximately 4 feet.

The above dimensions are examples. A person of ordinary skill will appreciate that the column cover portions described herein can be adjusted to be other sizes.

In certain embodiments as otherwise described herein, each of the column cover portions is formed of one or more of polypropylene, polyethylene, polyvinyl chloride (PVC), acrylonitrile styrene acrylate (ASA), polyurethane, or acrylonitrile butadiene styrene (ABS). Further, while the system includes polymer cover portions, in that the structure and shape of the cover portion is associated with a polymer construction, the cover portions can include a large percentage of filler. For example, a cover portion formed with a polyurethane matrix may include a majority of filler (such as fly ash) and still be considered a "polymer panel," as will be appreciated by those of ordinary skill in the art. Likewise, the polymer cover portions may include small sections that are made from another material, such as a metal. For example in some embodiments the fastening hem may include metal parts for stability.

In certain embodiments as otherwise described herein, each of the cover portions includes a coating disposed over at least the outer surface of the visible body. In some embodiments, the coating blocks ultraviolet (UV) light to protect the body of the cover portions from UV degradation. In some embodiments, the coating is decorative and imparts a particular visual aspect to the cover portions. For example, in some embodiments the coating is opaque and has a particular color. In other embodiments, the coating is transparent.

In some embodiments, the coating is variegated, such that different portions of the surface of the cover portions have different colors. For example, in some embodiments, the coating is partially transparent such that sections of the underlying material of the visible body show through the coating while other sections are overlaid with an opaque covering. In some embodiments the coating includes an image of a natural product. In some embodiments, the coating provides a texture to the surface of the panel, for example to provide a desired tactile sensation when the panel is touched.

In certain embodiments, the coating is applied directly to the outer surface of the cover portions. In other embodiments, the coating is applied to the surface of a mold and is secured to the material of the cover portions during the molding process. In some embodiments, the coating is provided as a liquid that is sprayed or otherwise applied onto the body of the cover portions or into the mold. In other embodiments the coating is a film or laminate that is stretched over or otherwise applied to the cover portion body. Still, in other embodiments the film or laminate coating is inserted into a mold before the molding process.

In certain embodiments as otherwise described herein, each of the cover portions is injection molded. In other embodiments, each of the cover portions is rotomolded, thermoformed, or cast. For example, in some embodiments the cover portions are formed of polyethylene and rotomolded. In some embodiments the cover portions are fabricated through an additive process. For example, in some embodiments the panels are made by 3D printing.

In certain embodiments as otherwise described herein, each of the cosmetic features 119 is a digitized rendering of a stone. For example, in some embodiments a natural stone is scanned using either a laser scanner or a white light scanner to form a digital 3D rendering of the stone. A mold is then fabricated using the digital rendering and the cover portions are produced with the digitized rendering of the stone from the mold. In other embodiments, digital rendering of the stone is used by a 3D printer to create the cover portions. Still in other embodiments, a cast is made from the naturally occurring stone, and a mold is subsequently made based on the cast.

In certain embodiments as otherwise described herein, the colors of the cover portions of the system are very similar in order to provide uniformity throughout the column covering. For example, in some embodiments the color difference between one cover portions and any neighboring wall sections is no more than 2 ΔE based on the Hunter Lab color scale. In other embodiments the difference in color between the cover portions and adjacent wall sections is more pronounced.

In certain embodiments this difference in color can provide a more natural aesthetic. For example, river rock often varies in color from one stone to the next. In some embodiments, this color variation is provided by a surface coating, such as a paint, on the visible body. In other embodiments, the color of the material of the cover portions is varied from one cover portion or adjacent wall section to the next. For example, in certain embodiments, a color of the material of the cover portion and a color of the material of the adjacent wall sections have a color difference of at least 2 ΔE, e.g., at least 4 ΔE, e.g., at least 10 ΔE. In some embodiments, the color difference between a cover portion of the system and at least each neighboring wall section of the system is at least 2 ΔE, e.g., at least 4 ΔE, e.g., at least 10 ΔE.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

What is claimed is:

1. A column cover comprising:

a first portion composed of polymeric material, the first portion comprising:

a first side panel having a first edge and a second edge;

a second side panel having a first edge and a second edge;

a front panel extending between the second edge of the first side panel and the second edge of the second side panel; and an outer surface having at least one textured contour that replicates a natural building material; and a second portion composed of polymeric material, the second portion comprising:

a first side panel having a first edge and a second edge, wherein the first side panel of the second portion is substantially coplanar with the first side panel of the first portion;

a second side panel having a first edge and a second edge;

a front panel extending between the second edge of the first side panel and the second edge of the second side panel; and an outer surface having at least one textured contour that replicates a natural building material, wherein the first edge of the first side panel of the first portion is spaced apart from the first edge of the first side panel of the second portion such that a gap is defined therebetween configured to at least partially receive a first wall or fence structure, wherein the column cover is a first column cover further comprising at least one upward extending protrusion projecting from and above a top edge of each of the first portion and the second portion, wherein each upward extending protrusion is configured to be received within corresponding recesses located in a second column cover to couple the first column cover thereto.

2. The column cover of claim 1, wherein each upward extending protrusion comprises a pair of said upwardly extending protrusions projecting from and above the top edge of the first portion and the second portion, wherein the upward extending protrusions are configured to couple to the second column cover.

3. The column cover of claim 1 wherein the first edge of the second side panel of the first portion is configured to interlock with the first edge of the second side panel of the second portion.

4. The column cover of claim 1 wherein the first side panel of the first portion and the second side panel of the first portion are substantially parallel.

5. The column cover of claim 1 wherein the first edge of the second side panel of the first portion is spaced apart from the first edge of the second side panel of the second portion such that a second gap is defined therebetween configured to at least partially receive a second wall or fence structure.

6. The column cover of claim 1 wherein the at least one textured contour of the first portion replicates a masonry unit.

7. The column cover of claim 6 wherein the first edge of the second side panel of the first portion substantially follows a portion of the at least one textured contour.

8. The column cover of claim 1 further comprising a top cap coupled to a top end of the first portion and a top end of the second portion.

9. The column cover of claim 8 wherein the top cap has at least one recess configured to receive at least one upward extending protrusion of the first portion.

10. The column cover of claim 1 wherein the second side panel of the first portion has a varying width along a length of the first edge thereof.

11. The column cover of claim 10 wherein the second side panel of the second portion has a varying width along a length of the first edge thereof.

12. The column cover of claim 10 wherein the second side panel of the first portion has an average width substantially equal to half a width of the front panel.

13. The column cover of claim 1 wherein the first portion further comprises a square channel shaped inner wall.

14. The column cover of claim 13 wherein the square channel shaped inner wall comprises:

a first inner side panel having a first edge and a second edge;

a second inner side panel having a first edge and a second edge; and an inner front panel extending from the second edge of the first inner side panel to the second edge of the second inner side panel.

15. The column cover of claim 14 wherein the first portion further comprises a back panel extending from the first edge of the first inner side panel to the first edge of the first side panel.

16. The column cover of claim 14 wherein the first inner side panel is spaced from the second inner side panel by a distance between approximately 3.5 inches and approximately 6 inches.

17. A method of assembling the column cover of claim 1, the method comprising:

receiving a first side of a post between a first inner side panel and a second inner side panel of a first column cover portion;

securing the first column cover portion to the post;

receiving a second side of the post between a first inner side panel and a second inner side panel of a second column cover portion;

positioning the second column cover portion relative to the first column cover portion such that a first edge of a first side panel of the second column cover portion is spaced apart from a first edge of a first side panel of the first column cover portion; and securing the second column cover portion to the post.

18. The method of claim 17 further comprising interlocking a first edge of a second side panel of the second column cover portion with a first edge of a second side panel of the first column cover portion.

19. The method of claim 17 further comprising:

positioning a third column cover portion above the first column cover portion;

receiving at least one upward extending protrusion of the first column cover portion within a recess of the third column cover portion; and securing the third column cover portion to the post.

* * * * *